US009103644B2

(12) United States Patent
Bezuidenhout et al.

(10) Patent No.: US 9,103,644 B2
(45) Date of Patent: Aug. 11, 2015

(54) SIGNAL TUBE CONNECTOR

(71) Applicant: AEL MINING SERVICES LIMITED, Sandton (ZA)

(72) Inventors: Hendrik Cornelius Bezuidenhout, Pretoria (ZA); Pieter Stephanus Jacobus Halliday, Randburg (ZA); Clifford Gordon Morgan, Kempton Park (ZA); Cheryl Lynn Kelly, Johannesburg (ZA); Andries Matthys Botha, Pretoria (ZA)

(73) Assignee: AEL MINING SERVICES LIMITED, Sandton (ZA)

( * ) Notice: Subject to any disclaimer, the term of this patent is extended or adjusted under 35 U.S.C. 154(b) by 0 days.

(21) Appl. No.: 14/352,583

(22) PCT Filed: Oct. 11, 2012

(86) PCT No.: PCT/ZA2012/000066
§ 371 (c)(1),
(2) Date: Apr. 17, 2014

(87) PCT Pub. No.: WO2013/059840
PCT Pub. Date: Apr. 25, 2013

(65) Prior Publication Data

US 2014/0305327 A1 Oct. 16, 2014

(51) Int. Cl.
*F42D 1/04* (2006.01)
*C06C 5/06* (2006.01)

(52) U.S. Cl.
CPC ... *F42D 1/04* (2013.01); *C06C 5/06* (2013.01); *F42D 1/043* (2013.01)

(58) Field of Classification Search
CPC ..... F42D 1/04; F42D 1/043; C06C 5/04; C06C 5/06
USPC ..... 102/275.2, 275.3, 275.4, 275.7, 275.12
See application file for complete search history.

(56) References Cited

U.S. PATENT DOCUMENTS

| | | | | |
|---|---|---|---|---|
| 5,204,492 | A | 4/1993 | Jacob et al. | |
| 5,659,149 | A * | 8/1997 | Sutula, Jr. | 102/275.7 |
| 5,665,932 | A | 9/1997 | Viljoen et al. | |
| 6,006,671 | A | 12/1999 | Yunan | |
| 7,661,365 | B2 * | 2/2010 | Chan | 102/275.12 |
| 7,798,065 | B2 * | 9/2010 | Chan et al. | 102/275.12 |

(Continued)

FOREIGN PATENT DOCUMENTS

| | | |
|---|---|---|
| FR | 2937638 | 4/2010 |
| WO | 03023315 | 3/2003 |

OTHER PUBLICATIONS

International Search Report and the Written Opinion of the International Searching Authority for Application No. PCT/ZA2012/000066 dated Feb. 6, 2013 (22 pages).
Written Opinion from for the International Preliminary Examining Authority for International Application No. PCT/ZA2012/000066 dated Oct. 9, 2013 (5 pages).

(Continued)

*Primary Examiner* — James S Bergin
(74) *Attorney, Agent, or Firm* — Michael Best & Friedrich LLP

(57) ABSTRACT

A signal tube connector which can be used with a number of signal tubes which includes a detonator receiving body and a retention member, wherein a signal tube locating space is formed between opposing surfaces of the body and the member and wherein the retention member is movable relative to the body and can be locked in place with a locking mechanism to retain signal tubes within the space.

12 Claims, 2 Drawing Sheets

(56) References Cited

U.S. PATENT DOCUMENTS 7,891,296 B2 * 2/2011 Husk et al. ..... 102/275.7
8,402,892 B1 * 3/2013 Scheid et al. ..... 102/275.12

OTHER PUBLICATIONS

International Preliminary Report on Patentability for International Application No. PCT/ZA2012/000066 dated Jan. 31, 2014 (9 pages).

* cited by examiner

SIGNAL TUBE CONNECTOR

BACKGROUND OF THE INVENTION

This invention relates to a connector for interconnecting a plurality of signal tubes such as shock tubes.

In a typical shock tube detonating system use is made of connectors, as appropriate, to interconnect shock tubes to ensure that correct propagation of a blast signal from one shock tube to another is reliably achieved. A single failure in the propagation process can result in a blast not being produced according to design, and this can cause significant production losses or downtime.

Shock tube initiating systems are in widespread use in the mining industry, in underground and in open pit environments. Connectors which are used to interconnect the shock tubes vary according to the number of shock tubes which must be coupled together. A typical connector is made in an injection moulding process and is designed to hold a detonator which, when fired, initiates shock tubes which are fixed to the connector. Normally the shock tubes, at a location at which the shock tubes are coupled to the connector, are held so that they are perpendicularly disposed relative to an elongate axis of the detonator.

Each shock tube should be securely attached to the connector and should not be capable of becoming inadvertently separated from the connector. One problem in this respect is that, as the number of shock tubes which are directly coupled to a single connector increases, the likelihood that the shock tubes can become detached from the connector also increases. It should be borne in mind that the shock tubes can be subjected to substantial tensile forces, particularly when used in rough mining conditions. A limited retentive force is available from a typical connector and this retentive force may not be sufficient to retain a number of shock tubes firmly anchored to a connector while an explosive system is being established. Another factor is that a detonator which is engaged with the connector may be movable slightly in a longitudinal direction relative to the connector. This type of movement can create a small gap between one or more of the shock tubes and the detonator and this, in turn, may adversely affect the firing of the shock tubes when the detonator is ignited.

By way of background information reference is made, for example, to U.S. Pat. No. 5,703,319 which discloses a connector block in which is formed an arcuate line-retaining slot disposed transversely to a longitudinal axis of a detonator at an output end of the detonator. This type of arrangement can be used only with a limited number of shock tubes. A similar observation is made with respect to the connector block disclosed in the specification of U.S. Pat. No. 7,798,065.

U.S. Pat. No. 5,204,492 discloses an arrangement in which shock tubes, coupled to a connector, are disposed generally parallel to each other and to a longitudinal axis of a detonator in a circumferential array around the detonator. A number of different connector designs are described, but there is no disclosure of an arrangement in which a connector can be coupled to a large number of shock tubes, e.g. 10 or more.

An object of the present invention is to provide a signal tube connector which can be used with a significant number of shock tubes and which, at least to some extent, addresses the aforementioned operational requirements.

SUMMARY OF INVENTION

The invention further extends to a signal tube connector which includes a detonator-receiving body with a longitudinal axis and at least one retention member, the detonator-receiving body and the retention member including respective surfaces which oppose each other and which form, between the surfaces, a signal tube locating space, the retention member being movable relative to the detonator-receiving body to vary the position of one of the opposing surfaces relative to the other opposing surface, and at least one locking mechanism which is operable to prevent movement of the retention member relative to the detonator-receiving body, characterised in that the retention member in cross-section parallel to the longitudinal axis has a dished shape with a curved section which extends towards an opposing surface of the detonator-receiving body, a central region of the curved section being closest to the longitudinal axis and adjacent regions of the curved section moving away from the longitudinal axis.

The detonator-receiving body may include a formation for receiving the detonator. This formation may be in the nature of an elongate channel, a slot, a passage or the like. The invention is not limited in this respect. A clip structure to prevent inadvertent removal of the detonator from the formation is preferably included in the body.

The retention member may be pivotally movable relative to the body. This pivotal movement may be about a pivot axis which is formed by means of a hinge joint, a line of weakness or the like. The invention is not limited in this respect. The retention member may be movable in an arc relative to the pivot axis. The retention member may be movable to extend laterally (radially outwardly) relative to a longitudinal axis of the body. The pivot axis is preferably parallel to and spaced from this longitudinal axis.

The locking mechanism may include any suitable arrangement and, in one form of the invention, complementary interengageable formations are provided on the retention member and on the body, or on the retention member and another retention member, or on the retention member and on material between the body and another retention member. For example the retention member may include a protrusion and the body may include a slot or aperture with which the protrusion is engageable, or vice versa.

The surface of the retention member which opposes the detonator-receiving body, in cross-section transverse to a longitudinal axis of the body, is preferably roughly semi-cylindrical. The surface of the retention member, or a surface of the detonator-receiving body which opposes the surface of the retention member, or both surfaces, may include keying formations such as serrations or the like which assist in gripping a signal tube which is positioned between these opposing surfaces.

The surface of the retention member which opposes the detonator receiving body, in cross-section parallel to a longitudinal axis of the body, is preferably curved i.e. towards the body and then away from the body with a central region of the curve being closest to the longitudinal axis.

The signal tube locating space, in cross-section transverse to a longitudinal axis of the body, may be roughly in the form of a semi-cylindrical slot. The signal tube locating space may have a varying width dimension so that one or more points or locations are created by the retention member at which increased pressure is applied to a signal tube positioned inside the signal tube locating space.

Preferably the connector includes at least two of the retention members. These members may be diametrically opposed to each other.

The invention further extends to a signal tube connector which includes an elongate body with a longitudinal axis, an elongate passage in the body which has an open mouth and an opposing end, detonator-engagement structure at the mouth, at least one retention member adjacent the opposing end which is pivotally movable relative to the body about an axis which is spaced from the longitudinal axis, and a locking mechanism for securing the retention member in an operative position to the body thereby preventing said relative pivotal movement and wherein, with the retention member in the operative position, a surface of the retention member opposes a surface of the body thereby forming a signal tube locating space between the opposing surfaces of the retention member and the body, characterised in that the signal tube locating space, in a first plane which includes the longitudinal axis, is arcuate (FIG. 5) and in a second plane which is transverse to the first plane, is arcuate.

A central region of the space may be closest to the longitudinal axis and adjacent regions of the space may be curved away from the longitudinal axis.

BRIEF DESCRIPTION OF THE DRAWINGS

The invention is further described by way of example with reference to the accompanying drawings in which.

DESCRIPTION OF PREFERRED EMBODIMENT

Figure 1:
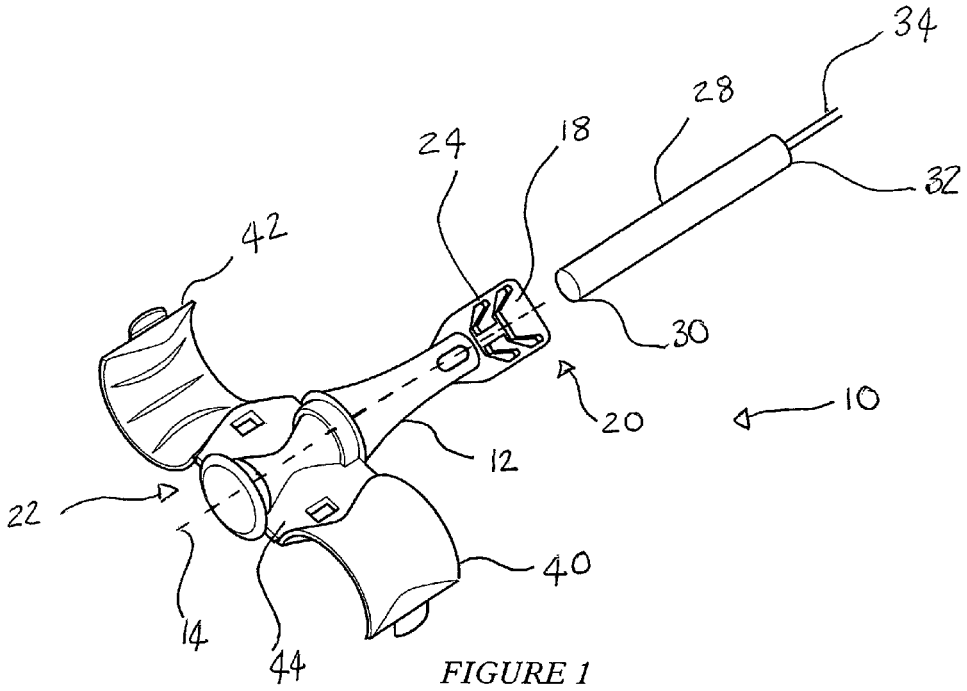
FIG. 1 is a view of a signal tube connector according to the invention in an inoperative configuration.
Figure 2:
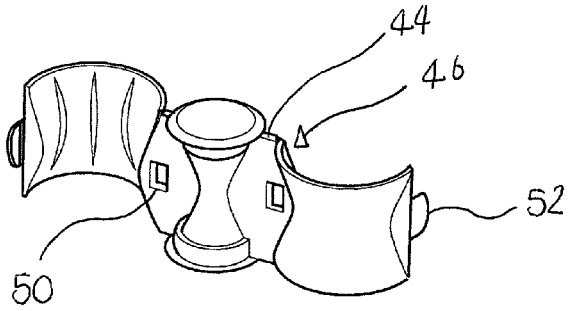
FIG. 2 shows a portion of the connector in FIG. 1.

FIG. 1 of the accompanying drawings illustrates a connector 10 which is made from a suitable plastic material using an injection moulding process.

The connector includes an elongate detonator-receiving body 12 with a longitudinal axis 14. The body is formed with a passage 18 with an open mouth or end 20 and opposing end 22 which may be a blind end or which may include an obstruction formation (not shown). An engagement structure 24 which includes a number of resiliently deflectable clips is positioned at the open end 20 and is designed to engage with a detonator 28, of any appropriate kind, which is dimensioned to be slid into the passage. In this way the detonator is correctly positioned inside the passage. The detonator includes a leading end 30 and a trailing end 32. The detonator is moved into the passage until it abuts the blind end or the obstruction formation, as the case may be. The detonator can be initiated by means of an electrical signal applied to leads 34, as is known in the art.

The use of the passage is optional, although preferable. It is possible, for example, for the connector to be formed with a slot, instead of the passage, into which the detonator is insertable with a lateral movement.

Figure 3:
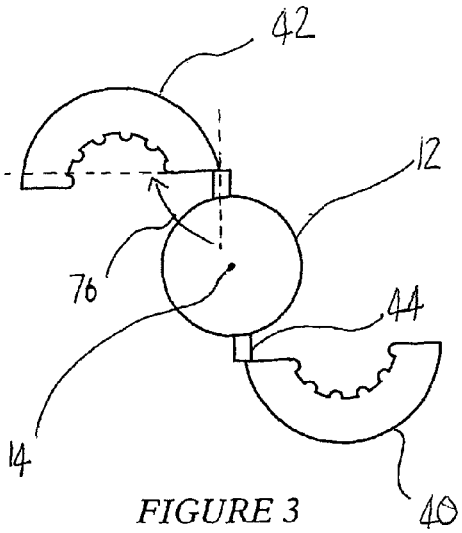
FIG. 3 is a view, in a direction of an arrow 3 in FIG. 1, of the connector.
Figure 4:
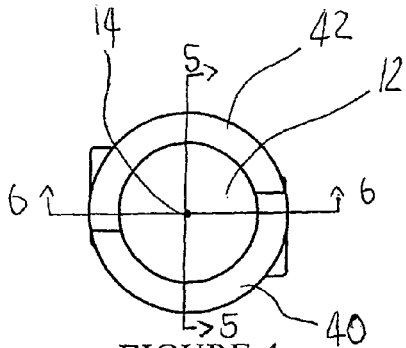
FIG. 4 is similar to FIG. 3 but with the connector in an operative mode.

Two substantially identical retention members 40 and 42 are positioned on the body adjacent the end 22 of the passage. A short flange 44 is integrally formed with the body 12 and with the retention member 40. The flange has a line of weakness, which comprises a relatively slender portion 46, which forms a hinge joint or pivot axis between the retention member 40 and the flange. The retention member can thus be pivoted inwardly towards the body 12 (FIG. 4), or away from the body (FIG. 3), according to requirement. This movement is about the pivot axis which is aligned with the hinge joint and which is parallel to and spaced from the longitudinal axis 14. The retention member 42 is similarly constructed.

A small aperture 50 is formed at a respective base of each flange i.e. between the retention member and the body. The arrangement is such that, referring for example to FIG. 6, when one retention member is moved towards the body a projection 52, at an outer end of the retention member can enter the aperture 50 associated with the other retention member. The projection 52 engages with a complementary fit with the aperture 50 and, in this way, the retention member can be locked to the body in what is referred to herein as an operative configuration—see for example FIGS. 4, 5 and 6.

Figure 5:
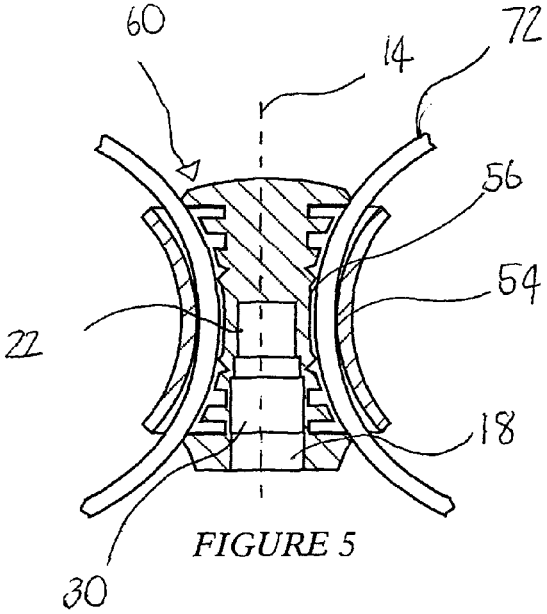
FIG. 5 is a view in section of part of the connector taken on a line 5-5 in FIG. 4.
Figure 6:
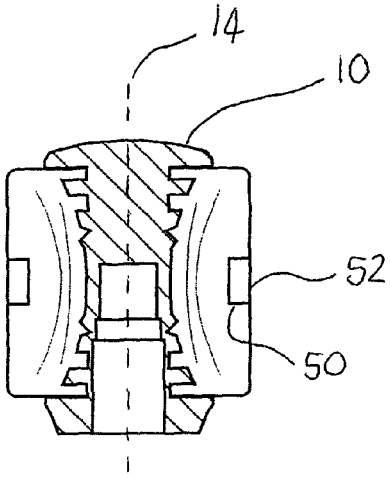
FIG. 6 is similar to FIG. 5 but taken on a line 6-6 in FIG. 4.

FIG. 5 shows the retention members from one side and in cross-section parallel to the axis 14. Each retention member has a dished shape and has an indented or inwardly projecting, curved section 54 which extends towards an opposing surface 56 of the detonator-receiving body.

A central region of the section 54 is closest to the axis 14, while adjacent regions curve away from the axis. With the retention member in the operative configuration, a signal tube locating space 60 is defined between opposing surfaces of the retention member and the detonator-receiving body adjacent the end 22 of the passage. One or both of these opposing surfaces includes serrations or keying formations which effectively alter the width 62 of the signal tube locating space which, in cross-section transverse the axis 14, is substantially in the form of a semi-cylindrical slot adjacent the end 22 of the detonator-receiving body.

When the connector is to be used the detonator 28 is inserted into the passage 18 in the manner which has been described. This process is substantially conventional. The leading end 30 of the detonator is thereby brought into contact with the end 22 of the passage. This end is preferably formed with one or more openings. Alternatively, a thin frangible plastic layer is positioned at the end to provide only a relatively small degree of separation between the signal tube locating space 60 and the leading end of the detonator.

With the retention members 40 and 42 in inoperative modes, i.e. flared open, as is shown in FIG. 1, a number of shock tubes 72 can be positioned side-by-side to one another, on an inner surface of one retention member. Thereafter the retention member is pivoted towards the body 12 and the projection 52 is engaged with the opposing aperture 50 to lock the retention member to the body. A further number of shock tubes can be coupled to the connector by using the other retention member in a similar manner.

The shock tubes are firmly held in position in close proximity to the leading end 30 of the detonator. The shock tubes naturally tend to bend away from the detonator. The clipping arrangement constituted by the formations 24 secures the detonator in position and the leading end 30 is thus kept at all times close to the shock tubes.

In an appropriate design of the connector each retention member can secure at least up to seven shock tubes to the connector i.e. at least up to 14 shock tubes can be coupled to the connector. The functionality of the device is not compromised if one retention member is not used or if only one or two shock tubes are coupled to the connector by means of one of the retention members.

The material which is used in the manufacture of the connector can be reinforced as appropriate or can be subjected to irradiation or other material treatment processes to enhance its mechanical properties. The passage 14 can be a continuous bore or it can be in the nature of a slot into which the detonator is inserted with a lateral movement.

FIG. 1 illustrates the use of two retention members. This can be varied according to requirement and three or four retention members can be employed. Each retention member would then couple a reduced number of shock tubes to the connector although the clipping force per detonator would be correspondingly increased.

Each retention member can be pivoted (angularly moved) relative to the body 12 through an angle of deflection 76 which can range at least from 5° to 90°.

The arrangement of the projection 52 which is engageable with a complementary aperture 50 is exemplary only and non-limiting. Any alternative appropriate clipping or locking arrangement can be used, as required, in place of, or in addition to, what has been illustrated.

The invention claimed is:

1. A signal tube connector (10) which includes a detonator-receiving body (12) with a longitudinal axis (14) and at least one retention member (40, 42), the detonator-receiving body (12) and the retention member (40, 42) including respective surfaces which oppose each other and which form, between the surfaces, a signal tube locating space (60), the retention member (40, 42) being movable relative to the detonator-receiving body (12) to vary the position of one of the opposing surfaces relative to the other opposing surface, and at least one locking mechanism (50, 52) which is operable to prevent movement of the retention member (40, 42) relative to the detonator receiving body (12), characterised in that the retention member (40, 42) in cross-section parallel to the longitudinal axis (14) has a dished shape with a curved section (54) which extends towards an opposing surface (56) of the detonator-receiving body (12), a central region of the curved section (54) being closest to the longitudinal axis (14) and adjacent regions of the curved section (54) moving away from the longitudinal axis (14).

2. A connector according to claim 1 wherein the detonator-receiving body (12) includes a formation (18) for receiving the detonator.

3. A connector according to claim 1 wherein the retention member (40, 42) is pivotally movable relative to the detonator-receiving body (12).

4. A connector according to claim 3 wherein the retention member (40, 42) is pivotally movable about a pivot axis (46) which is parallel to, and spaced from, a longitudinal axis of the detonator-receiving body.

5. A connector according to claim 1 wherein the locking mechanism (50, 52) comprises complementary interengageable formations (50, 52) which are provided on the retention member (40, 42) and on the detonator-receiving body; on the retention member (40,42) and on a second retention member (40, 42); or on the retention member (40, 42) and material between the detonator-receiving body and a second retention member (40, 42).

6. A connector according to claim 1 wherein the surface of the retention member (40, 42), which opposes the surface of the detonator-receiving body (12), in cross-section transverse to the longitudinal axis (14) of the detonator-receiving body (12), is semi-cylindrical.

7. A connector according to claim 1 wherein the surface of the retention member (40, 42), is curved, in cross-section parallel to the longitudinal axis (14) of the detonator-receiving body (12).

8. A connector according to claim 1 wherein the signal tube locating space (60), in cross-section transverse to the longitudinal axis (14) of the body, is in the form of a semi-cylindrical slot.

9. A connector according to claim 1 wherein the signal tube locating space (60) has a varying width dimension so that one or more locations are created at which increased pressure is applied to a signal tube positioned inside the signal tube locating space (60).

10. A connector according to claim 1 which includes two of the retention members (40, 42) which are respectively positioned, relative to the detonator-receiving body (12), diametrically opposing each other.

11. The signal tube connector (10) according to claim 1, the connector 10 further including an elongate passage (18) in the body (12) which has an open mouth (20), an opposing end (2) and detonator-engagement structure (24) at the mouth (20), wherein the at least one retention member (40, 42) is adjacent the opposing end and is pivotally movable relative to the body (12) about an axis (46) which is spaced from the longitudinal axis (14), wherein the locking mechanism (50, 52) secures the retention member (40, 42) in an operative position to the body (12) thereby preventing said relative pivotal movement with the retention member (40, 42) in the operative position.

12. The signal tube connector (10) according to claim 1, further characterized in that a surface of the retention member (40, 42) opposes a surface of the body (12) thereby forming a signal tube locating space (60) between the opposing surfaces of the retention member (40, 42) and the body (12), said surface of the retention member (40, 42) in cross-section transverse to the longitudinal axis (14) of the body (12) is roughly semi-cylindrical and the signal tube locating space (60) in cross-section transverse to the longitudinal axis (14) of the body is roughly in the form of a semi-cylindrical slot.

* * * * *